US007529663B2

(12) United States Patent
Byun et al.

(10) Patent No.: US 7,529,663 B2
(45) Date of Patent: May 5, 2009

(54) METHOD FOR FLEXIBLE BIT RATE CODE VECTOR GENERATION AND WIDEBAND VOCODER EMPLOYING THE SAME

(75) Inventors: Kyung-Jin Byun, Daejon (KR); Ik-Soo Eo, Daejon (KR); Kyung-Soo Kim, Daejon (KR); Hee-Bum Jung, Daejon (KR)

(73) Assignee: Electronics and Telecommunications Research Institute (KR)

( * ) Notice: Subject to any disclaimer, the term of this patent is extended or adjusted under 35 U.S.C. 154(b) by 652 days.

(21) Appl. No.: 11/216,430

(22) Filed: Aug. 30, 2005

(65) Prior Publication Data

US 2006/0116872 A1 Jun. 1, 2006

(30) Foreign Application Priority Data

Nov. 26, 2004 (KR) ..... 10-2004-0098189

(51) Int. Cl.
*G10L 19/12* (2006.01)
*G10L 19/10* (2006.01)

(52) U.S. Cl. ..... 704/223; 704/221; 704/219

(58) Field of Classification Search ..... 704/219–223, 704/230

See application file for complete search history.

(56) References Cited

U.S. PATENT DOCUMENTS 4,890,327 A * 12/1989 Bertrand et al. ..... 704/219
5,878,387 A * 3/1999 Oshikiri et al. ..... 704/207
6,055,496 A * 4/2000 Heidari et al. ..... 704/222
6,173,257 B1 * 1/2001 Gao ..... 704/220
6,249,758 B1 * 6/2001 Mermelstein ..... 704/220
6,427,135 B1 * 7/2002 Miseki et al. ..... 704/258
6,604,070 B1 * 8/2003 Gao et al. ..... 704/222
6,606,600 B1 * 8/2003 Murgia et al. ..... 704/500

(Continued)

FOREIGN PATENT DOCUMENTS

KR 10-2004-0041716 5/2004

OTHER PUBLICATIONS

3GPP TS 26.171 "AMR Wideband Speech Codec," 3GPP Technical Specification, 2001.*

(Continued)

*Primary Examiner*—Talivaldis I Smits
*Assistant Examiner*—Jialong He
(74) *Attorney, Agent, or Firm*—Blakely, Sokoloff, Taylor & Zafman

(57) ABSTRACT

Provided are a flexible bit rate code vector generation method and a wideband vocoder employing the same. This invention implements a flexible bit rate by getting three code vectors which are composed of 24, 16, and 8 pulses, at a time in a search process, through improvement of an algebraic codebook search process in a wideband AMR-WB vocoder. The method includes the steps of: performing a preprocess, wherein the preprocess divides a sub-frame by tracks and decides a pulse position having a maximum value in each track; among a plurality of pulses to be searched, fixing a same number of pulses as the tracks to the position with the maximum value of each track sequentially, and searching optimal positions having a minimum error with a target signal by combining two pulses in two consecutive tracks for the remaining pulses; and creating a code vector with flexible bit rate.

9 Claims, 9 Drawing Sheets

U.S. PATENT DOCUMENTS

| | | | | |
|---|---|---|---|---|
| 6,714,907 | B2 * | 3/2004 | Gao | 704/220 |
| 7,280,959 | B2 * | 10/2007 | Bessette | 704/219 |
| 2002/0052738 | A1 | 5/2002 | Paksoy et al. | |
| 2002/0138260 | A1 * | 9/2002 | Kim et al. | 704/230 |
| 2004/0024594 | A1 * | 2/2004 | Lee et al. | 704/219 |
| 2004/0030548 | A1 * | 2/2004 | El-Maleh et al. | 704/230 |
| 2004/0117176 | A1 * | 6/2004 | Kandhadai et al. | 704/223 |

OTHER PUBLICATIONS

VoiceAge, "Wideband Speech Coding Standards and Applications". White paper, 2005.*

"A 16-bit/s Bandwidth Scalable Audio Coder BAsed on The G.729 Standard", K. Koishida, et al., Jun. 2000 IEEE, pp. 1149-1152.

"A Two-Stage Hybrid Embedded Speech/Audio Coding Structure", S. Ramprashad, May 1988 IEEE, pp. 337-340.

* cited by examiner

METHOD FOR FLEXIBLE BIT RATE CODE VECTOR GENERATION AND WIDEBAND VOCODER EMPLOYING THE SAME

FIELD OF THE INVENTION

The present invention relates to a method for generating a flexible bit rate code vector and a wideband vocoder employing the same. More particularly, this invention concerns a code vector generation method and a wideband vocoder employing it, which is capable of implementing a flexible bit rate by getting three code vectors, which are composed of 24, 16, and 8 pulses, at a time in a search process through an improvement of an algebraic codebook search process in a wideband adaptive multi-rate wideband (AMR-WB) vocoder.

DESCRIPTION OF RELATED ART

A digital mobile communication system using a bandwidth of transmission channel efficiently employs various voice coding algorithms for a high quality of voice in wireless channel environment.

In general, the code excited linear prediction (CELP) algorithm is one of the effective coding methods that maintain a high quality of voice at low transfer rate of 4 to 8 Kbps. As one of such CELP coding methods, there exists the algebraic code excited linear prediction (ACELP), which has been recognized as a successful method, as adopted in the recent many world standards such as G.729, enhanced variable rate coder (EVRC), and AMR. However, as the communication systems evolve into a service of multimedia from a service for voice call, there have been also proposed the wideband voice coding methods of 50 Hz to 7 KHz, developed from the narrowband coding methods of 200 Hz to 3.4 KHz.

Meanwhile, the wideband AMR-WB vocoder is the voice coding algorithm most recently standardized in 3GPP and is designated as standard called ITU-T G.722.2. This vocoder can compress and decompress a voice or audio signal of 70 Hz to 7 KHz, thereby highly improving the clearness and naturalness compared to the exiting narrowband vocoder.

Further, the AMR-WB vocoder has nine types of bit rates of 23.85 Kbps to 6.60 Kbps, but each coding method of each bit rate is similar one another since its basic algorithm adopts the ACELP algorithm.

On the other hand, with the increase of multimedia services in the teleconference and the Internet applications, the importance of packet voice communication has become even high. In this network, however, there has been a problem on the voice communication due to a loss of packets by a congestion of the network, excessive delay time, overflow of buffer, etc. One of methods that are capable avoiding a deterioration of the voice quality arising due to such loss of packet data employs a flexible bit rate vocoder.

Typically, the flexible bit rate vocoder comprises a core block and an enhancement block. The core block creates a bit stream necessary to provide a basic voice quality, and the enhancement block produces a bit stream to offer a better voice quality. Since the bit streams provided by the core block and the enhancement block are independent each other, it would be possible to guarantee the basic quality unless the bit stream by the core block is corrupted although the bit stream by the enhancement block is corrupted, according to the circumstance of the network. And, if the bit stream by the enhancement block is also received at a receiver, without any error, a finer voice quality can be reproduced.

Among many prior arts regarding the invention, U.S. Patent Publication No. 2002/0052738 A1 published on May 2, 2002, which will be called a first prior art, hereinafter, discloses "Wideband Speech Coding System and Method." Also, an article entitled "A16-kbit/s Bandwidth Scalable Audio Coder based on the G.729 Standard," which will be called a second prior art, is published by Kazuhito Koishida et al., in ICASSP 2000 proceeding, Vol. 2, pp. 1149-1152, 5-9 Jun. 2000, and an article entitled "A Two Stage Hybrid Embedded Speech/Audio Coding Structure, which will be called a third prior art, is disclosed by Sean A. Ramprashad, in ICASSP 1998 proceeding, Vol. 1, pp. 337-340, 12-15 May 1998.

Even though the first to third prior arts are similar to the invention in that they implement a flexible bit rate, the first prior art gets the flexible bit rate by conducting the coding by means of a division of the high band and the low band while the invention implements the flexible bit rate by obtaining three code vectors at a time in the process of an algebraic codebook search. Hence, the first prior art is substantially different from the present invention. Further, the second prior art offers a flexible bandwidth by coding a narrow signal in the basic block and a wideband signal in the enhancement block, whereas the present invention accomplishes the flexible bit rate by getting three code vectors in the algebraic codebook search process. Furthermore, the third prior art has the flexible bit rate by performing the coding using G.729 or G.723.1 vocoder in the core block and MDCT method in the enhancement block, while the present invention establishes the flexible bit rate by obtaining three code vectors in the algebraic codebook search process. Therefore, this prior art is basically different from the present invention.

According to the prior arts as set forth above, it needs to implement the enhancement block additionally, in order to provide the flexible bit stream for a better voice quality in the vocoder. Thus, there has been urgently required a scheme that can offer the flexible bit rate, without using the additional functional block, i.e., the enhancement block.

As discussed early, in the packet voice communication, a portion of packets may be corrupted or lost due to a congestion of the network, excessive delay time, and so on. Hence, as one method of avoiding a distortion of voice by this packet loss, it is possible to provide a superior voice quality when the circumstance of the network is good while guaranteeing a minimum voice quality even when the circumstance is not good, through the use of the flexible bit rate vocoder.

SUMMARY OF THE INVENTION

It is, therefore, a primary object of the present invention to provide a code vector generation method and a wideband vocoder employing it, which is capable of implementing a flexible bit rate by getting three code vectors, which is composed of 24, 16, and 8 pulses, at a time in a search process, through an improvement of an algebraic codebook search process in a wideband AMR-WB vocoder.

The other objectives and advantages of the invention will be understood by the following description and also will be seen by the embodiments of the invention more clearly. Further, the objectives and advantages of the invention will readily be seen that they can be realized by the means and its combination specified in the claims.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE INVENTION

Figure 1:
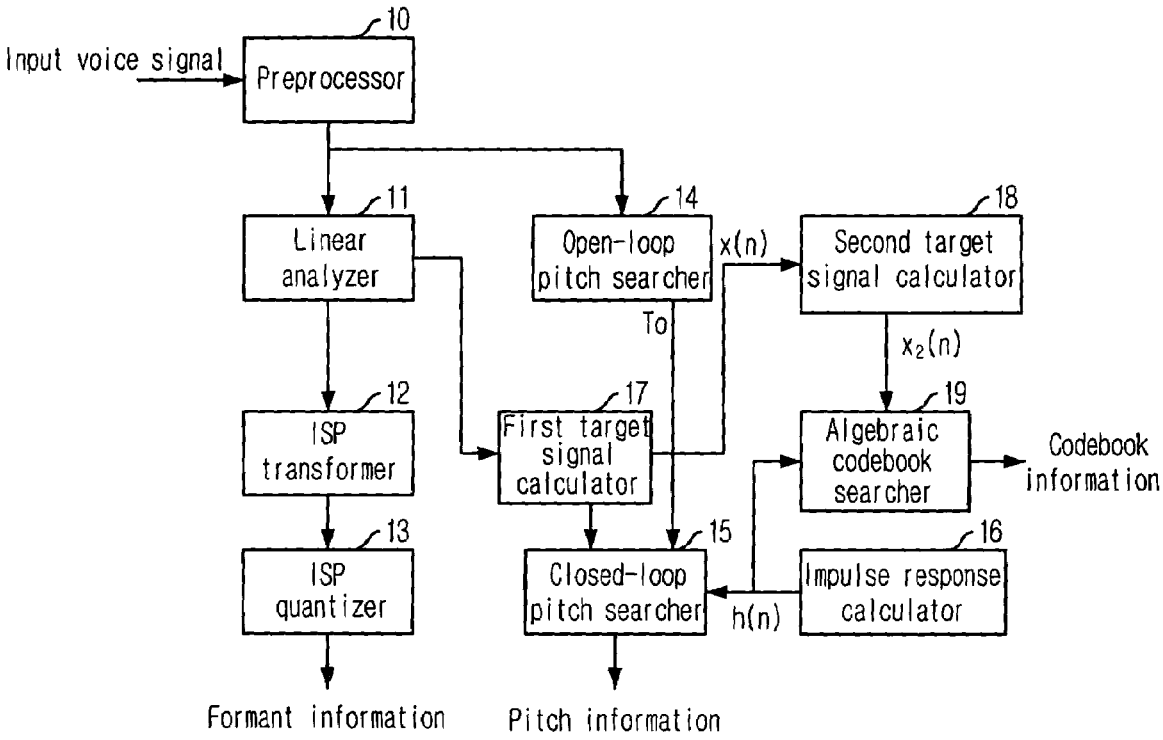
FIG. 1 shows a block diagram illustrating a configuration of an encoder in an AMR-WB vocoder to which the present invention is applied.
Figure 2:
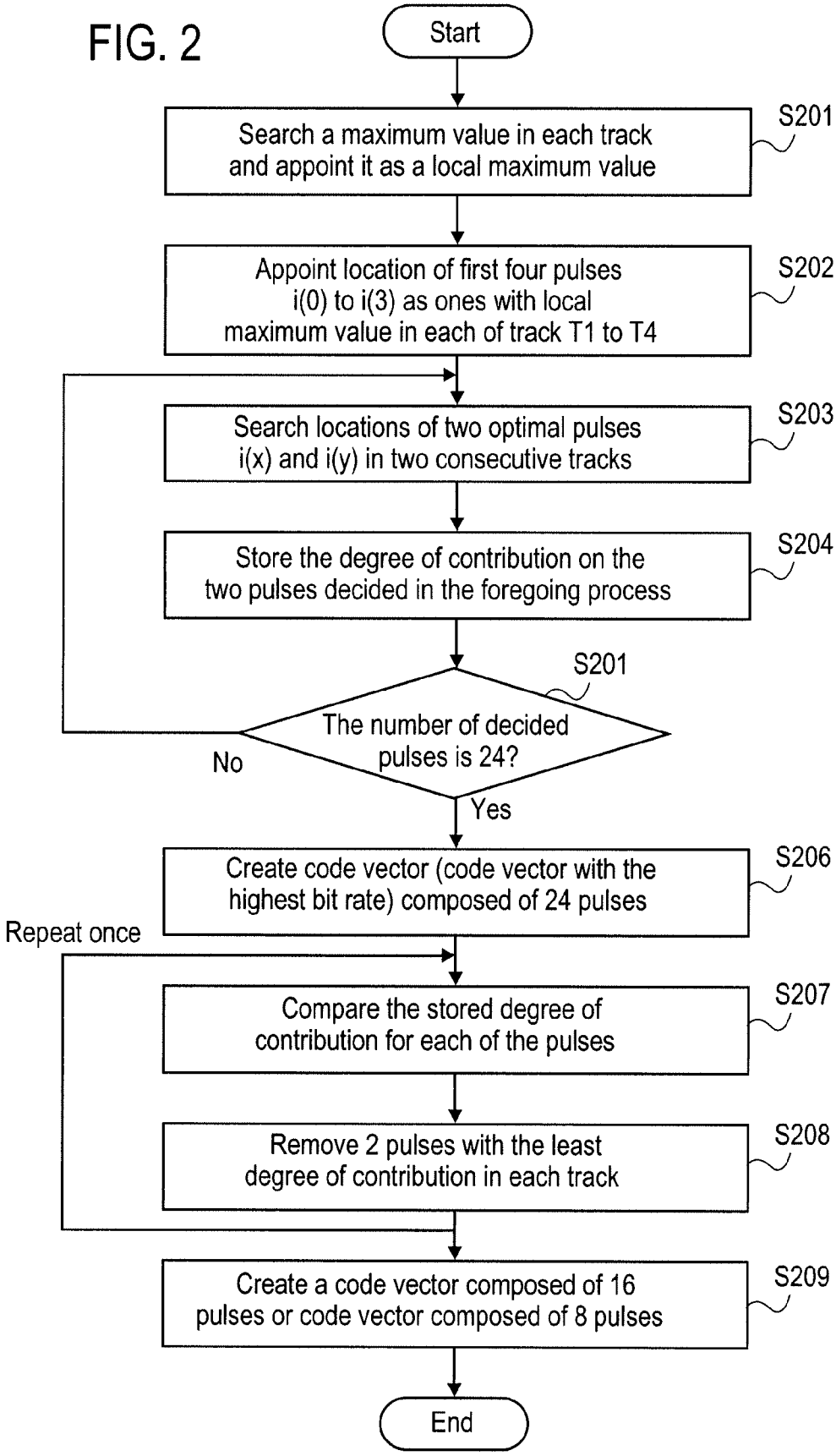
FIG. 2 depicts a flow chart explaining one embodiment of a method for a flexible bit rate code vector generation in accordance with the present invention.

In accordance with one aspect of the present invention, there is provided a method of generating a flexible bit rate code vector in an encoder of a vocoder, comprising the steps of: a) performing a preprocess, wherein the preprocess divides a sub-frame by tracks and decides a pulse position having a maximum value in each track; b) among a plurality of pulses to be searched, fixing a same number of pulses as the tracks to the position with the maximum value of each track sequentially, and searching optimal positions having a minimum error with a target signal by combining two pulses in two consecutive tracks for the remaining pulses; and c) creating a code vector with flexible bit rate by adjusting the number of pulses per each track by means of a removal of two pulses with a low degree of contribution in each track.

In accordance with another aspect of the present invention, there is provided a wideband vocoder for encoding and transmitting the code vector created by the method as specified above, wherein the vocoder derives at least two types of excitation code vectors at a time in an algebraic codebook search process, by adjusting the number of pulses for each track using the degree of contribution of pulses in said each track.

Further, the present invention provides a computer readable storage medium in an encoding device of a vocoder to create a flexible bit rate code vector, wherein the storage medium stores the following functions of: performing a preprocess, wherein the preprocess divides a sub-frame by tracks and decides a pulse position having a maximum value in each track; among a plurality of pulses to be searched, fixing a same number of pulses as the tracks to the position with the maximum value of each track, and searching optimal positions having a minimum error with a target signal by combining two pulses in two consecutive tracks for the remaining pulses; and creating a code vector with flexible bit rate by adjusting the number of pulses per each track by means of a removal of two pulses with a low degree of contribution in each track.

The present invention implements a wideband vocoder, clearly, a flexible bit rate vocoder using a code vector generation method of the present invention, by modifying an algebraic codebook search process of an AMR-WB vocoder, without using any additional functional block.

The flexible bit rate wideband vocoder proposed in the invention has three different bit rates, wherein the bit rate offering a basic voice quality is 12.65 Kbps mode, the bit rate providing the best voice quality is 27.85 Kbps mode, and the intermediate bit rate is 19.85 Kbps mode. Therefore, if the packet data transfer of 12.65 Kbps is secured in a network, then a receiver can restore a voice that guarantees a basic quality; and if the packet data transfer of 19.85 Kbps or 27.85 Kbps, as a higher bit rate, is secured in the network, then a voice signal with a better quality can be reconstructed.

In comparison with the existing flexible bit rate vocoders that improve the quality of voice by creating a bit stream of the lowest bit rate by the core block and adding an additional bit rate created by the enhancement block to the bit stream of low bit rate, the flexible bit rate vocoder of the invention can create bit streams of three bit rates at a time without using the additional enhancement block, by first creating a bit stream with the highest bit rate and then creating bit streams with the remaining two low bit rates through an improvement of an algebraic codebook search process in the highest bit rate mode of the AMR-WB vocoder.

As mentioned above, the present invention can implement the flexible bit rate wideband vocoder with the three different bit rates based on the wideband AMR vocoder. This flexible bit rate may be established by getting three excitation vectors at a time in the search process through the improvement of the algebraic codebook search process in the AMR-WB vocoder.

Through the code vector generation method of the invention, the flexible bit rate wideband vocoder provides the same performance as the AMR-WB vocoder of identical bit rate for the highest bit rate while having the flexible bit rate, but shows a slightly increased bit rate because of a decrease in the encoding efficiency. And, it has the same bit rate compared to the AMR-WB vocoder of identical bit rate for the lowest bit rate, but the voice quality is slightly degraded. However, despite of the degradation of this voice quality and the increase of the bit rate, the invention can provide the flexible bit rate; and, therefore, this invention has an advantage in that it can maintain an optimal performance in accordance with the circumstance of the network. In other words, since the bit streams of the remaining two low bit rates are contained in the highest bit stream, the voice signal with basic quality can be reconstructed if only the bit stream of the lowest bit rate is transmitted even though there is a partial packet loss in the process of the transmission. And, if there is a less packet loss or no packet loss, the voice with a higher quality than the basic quality can be restored.

The above-mentioned objectives, features, and advantages will be apparent by the following detailed description in associated with the accompanying drawings; and, according to this, the technical spirit of the invention will readily be conceived by those skilled in the art to which the invention belongs. Further, in the following description, if it seems that a concrete explanation of the known art used in the invention is unnecessary, because of a possibility that the gist of the invention becomes obscure, such explanation will be omitted for the sake of clearness. Hereinafter, a preferred embodiment of the present invention will be described in detail with reference to the accompanying drawings.

FIG. 1 shows a block diagram illustrating a configuration of an encoder in a wideband AMR-WB vocoder to which the present invention is applied.

The wideband AMR-WB vocoder is comprised of a coding algorithm with multiple bit rates that are operable at nine different bit rates of 23.85 Kbps, 23.05 Kbps, 19.85 Kbps, 18.25 Kbps, 15.85 Kbps, 14.25 Kbps, 12.65 Kbps, 8.85 Kbps, and 6.60 Kbps, according to a variation of communication channels.

Although this wideband AMR-WB vocoder is operable at the nine different bit rates, each coding algorithm is based on the ACELP algorithm and regulates such bit rates by modifying the quantizing methods for each parameter. Therefore, in the mode of more than 12.65 Kbps, it provides a wideband voice of high quality, and the modes of 8.85 Kbps and 6.60 Kbps are temporarily used only under the environment such as highly deteriorative channels or congestion of the network.

Referring to FIG. 1, the AMR-WB vocoder extracts each parameter by setting 256 samples (20 ms) of voice signal sampled at 12.8 KHz as one frame. Thus, the input voice signal sampled at 16 KHz is first operated in the decimation process of 12.8 KHz. In this decimation process, the input signal is first up-sampled by 4 times, and then down-sampled by ⅕ by a low pass FIR filter with a cutoff frequency of 6.4 KHz.

After doing the decimation, a preprocessing on the signal is performed by a preprocessor 10, which removes an unnecessary low frequency component and emphasizes a high frequency component using a high pass filter with a cutoff frequency of 50 Hz.

After the preprocessing, linear predictive coding (LPC) coefficients of 16 degree are derived by a linear analyzer 11 that uses an asymmetric window of 30 ms and Levinson-Durbin algorithm, to extract a Formant component. The LPC coefficients so derived are transformed into immittance spectral pair (ISP) coefficients that reduce quantization distortion and transfer errors, and have a good interpolation characteristic in an ISP transformer 12, which are then fed to a vector quantizer 13 for vector quantization.

That is, a moving average (MA) prediction of the first degree is performed and the remaining ISF vectors are then quantized by using a split vector quantization (SVQ) technique and a multi-stage vector quantization (MSVQ) technique in the vector quantizer 13.

On the other hand, pitch analysis process in the AMR-WB vocoder is largely divided into open-loop search process and closed-loop search process.

First of all, in order to reduce a total computation amount, a delay value with integer value is first determined in an open-loop pitch searcher 14, and then a closed-loop search on values neighboring to that value is conducted in a closed-loop pitch searcher 15.

During the open-loop pitch search, the search is done for a weighted voice signal, in which the search is carried out once per frame only in the mode of 6.60 Kbps, and twice per frame in the remaining modes.

When the open-loop search has been completed, an impulse response and target signal x(n) are computed by an impulse response calculator 16 and a first target signal calculator 17, respectively, for the closed-loop search.

After that, Closed-loop pitch analysis is performed around the open-loop pitch delays decided by the open-loop pitch searcher 14. The closed-loop pitch search is performed by minimizing the mean square error between the original and synthesized speech to find optimum integer pitch delay. Once the optimum integer pitch delay is determined, the fractional delay is searched around the optimum integer delay value. Herein, a pitch delay of fractional value uses a resolution of ¼ and ½ samples, according to each mode and a predefined range of the pitch delay. Thereafter, for the algebraic codebook search, a target signal $x_2(n)$ is computed by a second target signal calculator 18. The target signal $x_2(n)$ is derived by removing pitch components from the target signal x(n) provided by the first target signal calculator 17.

Next, in an algebraic codebook searcher 19, a position of each pulse and its sign are also determined, in order to minimize a mean square error with the voice signals synthesized with the target signal $x_2(n)$. The algebraic codebook uses 24 (23.85 Kbps) to 2 (6.6 Kbps) number of pulses per sub-frame, in accordance with each bit rate. Basically, for all of the nine modes, search algorithms are identical in that they use a depth first tree search method of ACELP, but the methods of searching such pulses are configured differently one another somewhat since the number of pulses and structures of tracks modeled for each mode are different. And, since the number of pulses to be searched is greatly increased in comparison with the algebraic codebook search of the narrowband AMR vocoder, the search range is quite limited to decrease the computational complexity.

The target signal used in the process of the algebraic codebook search is computed by the following formula (1) and the sign of each pulse is determined in advance to reduce the computational complexity in the search process.

$$x_2(n)=x(n)-g_p y(n),\ n=0,\ldots,63 \qquad \text{Eq. (1)}$$

Where {y(n)=v(n)*h(n)} represents a filtered adaptive codebook vector, and $g_p$ is a gain of quantized adaptive codebook.

In the algebraic codebook search, a pulse stream of excitation signal is searched by minimizing the mean square error between the input speech and the synthesized speech:

$$\epsilon_k=\|x-gHc_k\|^2 \qquad \text{Eq. (2)}$$

Wherein x is a target signal produced by subtracting the adaptive codebook contribution, g is the codebook gain, (H=h′h) is lower triangular Toepliz convolution matrix, and $c_k$ indicates an algebraic code vector having an index of k. Minimize Eq. (2) above is the same as maximizing the following formula:

$$Q_k=\frac{(R_k)^2}{E_k}=\frac{(x'Hc_k)^2}{c_k'H'Hc_k}=\frac{(d'c_k)^2}{c_k'\Phi c_k} \qquad \text{Eq. (3)}$$

Where ($d=H'x_2$) is a signal representing the relationship between the target signal $x_2(n)$ and the impulse response h(n), which is called backward filtered target signal. And, {$\phi=H'H$ (H is Toeplitz convolution matrix)} is a correlation matrix of h(n). The signal d(n) and correlation formula $\Psi(i,j)$ are computed in advance before the search, to reduce the computational complexity in the search process.

The AMR-WB vocoder is a vocoder supporting the multiple bit rates, but each bit stream for a constant bit rate is fixed to one. However, if, in a structure of bit stream being transmitted, a bit stream of low bit rate is involved within a bit stream with high bit rate, then original voice can be recovered in the form of bit stream of low bit rate in a receiver although a part of the bit stream of high bit rate is corrupted. In the bit allocation for each parameter in the AMR-WB vocoder, the modes of 12.65 Kbps to 23.85 Kbps are different only for the bit allocation of the algebraic codebook but identical for the bit allocation of the remaining parameters, as indicated in the following Table 1 (the bit allocation of the AMR-WB vocoder). However, in case of 23.85 Kbps, it is merely different to add the process of computing the energy of high frequency component after the algebraic codebook search. Therefore, using the similar bit allocation in the modes, the flexible bit rate vocoder can be implemented. That is, the bit allocation for the excitation signal can be done flexibly by modifying the algebraic codebook search portion making the excitation signal appropriately.

TABLE 1

| Parameter | Bit rate mode (kbit/s) | | | | | | | | |
|---|---|---|---|---|---|---|---|---|---|
| | 6.60 | 8.85 | 12.65 | 14.25 | 15.85 | 18.25 | 19.85 | 23.05 | 23.85 |
| VAD flag | 1 | 1 | 1 | 1 | 1 | 1 | 1 | 1 | 1 |
| LTP flag | 0 | 0 | 4 | 4 | 4 | 4 | 4 | 4 | 4 |
| ISP | 36 | 46 | 46 | 46 | 46 | 46 | 46 | 46 | 46 |
| Pitch | 23 | 26 | 30 | 30 | 30 | 30 | 30 | 30 | 30 |
| Algebraic codebook | 48 | 80 | 144 | 176 | 208 | 256 | 288 | 352 | 352 |
| Gain | 24 | 24 | 28 | 28 | 28 | 28 | 28 | 28 | 28 |
| High frequency energy | 0 | 0 | 0 | 0 | 0 | 0 | 0 | 0 | 16 |
| Total bit number | 132 | 177 | 253 | 285 | 317 | 365 | 397 | 461 | 477 |

In the algebraic codebook algorithm, the sub-frame is divided by predefined tracks, and then the constant number of pulses is allocated to each track, to efficiently model the excitation signal of the sub-frame. And, the size of each pulse is also fixed to .+−.1 in advance to decrease the computational complexity in the search process. In case of the mode of 23.85 Kbps in the AMR-WB vocoder, the excitation signals of the 64 sub-frames are divided by 4 tracks and the modeling is made using 6 pulses per each track, as shown in Table 2 (the algebraic codebook structure of 23.85 Kpbs mode in the ARM-WB), thus transmitting the positions and sign information for the total 24 pulses. In the algebraic codebook search for deciding the positions of the total 24 pulses, 2 pulses in consecutive tracks are combined to search optimal positions; and therefore, there exist the levels of total 12 steps. TABLE-US-00002 TABLE 2 Track Pulse Location 1i0, i4, i8, i12, i16, i20 0, 4, 8, 12, 16, 20, 24, 28, 32, 36, 40, 44, 48, 52, 56, 60 2 i1, i5, i9, i13, i17, i21 1, 5, 9, 13, 17, 21, 25, 29, 33, 37, 41, 45, 49, 53, 57, 61 3 i2, i6, i10, i14, i18, i22 2, 6, 10, 14, 18, 22, 26, 30, 34, 38, 42, 46, 50, 54, 58, 62 4i3, i7, i11, i15, i19, i23 3, 7, 11, 15, 19, 23, 27, 31, 35, 39, 43, 47, 51, 55, 59, 63

TABLE 2

| Tract | Pulse | Location |
|---|---|---|
| 1 | i0, i4, i8, i12, i16, i20 | 0, 4, 8, 12, 16, 20, 24, 28, 32, 36, 40, 44, 48, 52, 56, 60 |
| 2 | i1, i5, i9, i13, i17, i21 | 1, 5, 9, 13, 17, 21, 25, 29, 33, 37, 41, 45, 49, 53, 57, 61 |
| 3 | i2, i6, i10, i14, i18, i22 | 2, 6, 10, 14, 18, 22, 26, 30, 34, 38, 42, 46, 50, 54, 58, 62 |
| 4 | i3, i7, i11, i15, i19, i23 | 3, 7, 11, 15, 19, 23, 27, 31, 35, 39, 43, 47, 51, 55, 59, 63 |

In the algebraic codebook search of the mode of 23.85 Kbps in the AMR-WB vocoder, the code vector composed of total 24 pulses is created. In contrast, in the vocoder with the scalable bit rate provided in the invention, three code vectors of 24, 16, and 8 pulses are derived by improving the algebraic codebook search method. In the algebraic codebook search process (the algebraic codebook searcher 19) of the flexible bit rate vocoder proposed in the invention, the process (the flexible bit rate code vector generation method of the invention) of getting the three code vectors will be explained in detail with reference to FIGS. 2 to 5 below.

In the flexible bit rate code vector generation method of the present invention, the three excitation code vectors are derived by adjusting the number of pulses per each track using the degree of contribution of pulses within each track at a time in the algebraic codebook process. Using such code vector generation method, the flexible bit rate vocoder can be also implemented.

Specifically, first of all, in step S201, to derive the three excitation code vectors, a maximum value in each track is searched and it is appointed as a local maximum value before the algebraic codebook search. In other words, using the target signal that is derived by removing the linear predictive component and the pitch component, the sub-frame with 64 samples is divided by 4 tracks with 16 sample positions; and then a maximum value in each track is searched and it is appointed as a local maximum value, which is the numerals 30 to 33 in FIG. 3.

After that, in step S202, the positions of the first 4 pulses i(0) to i(3) are appointed as ones with local maximum values in each of tracks T1 to T4.

Figure 3:
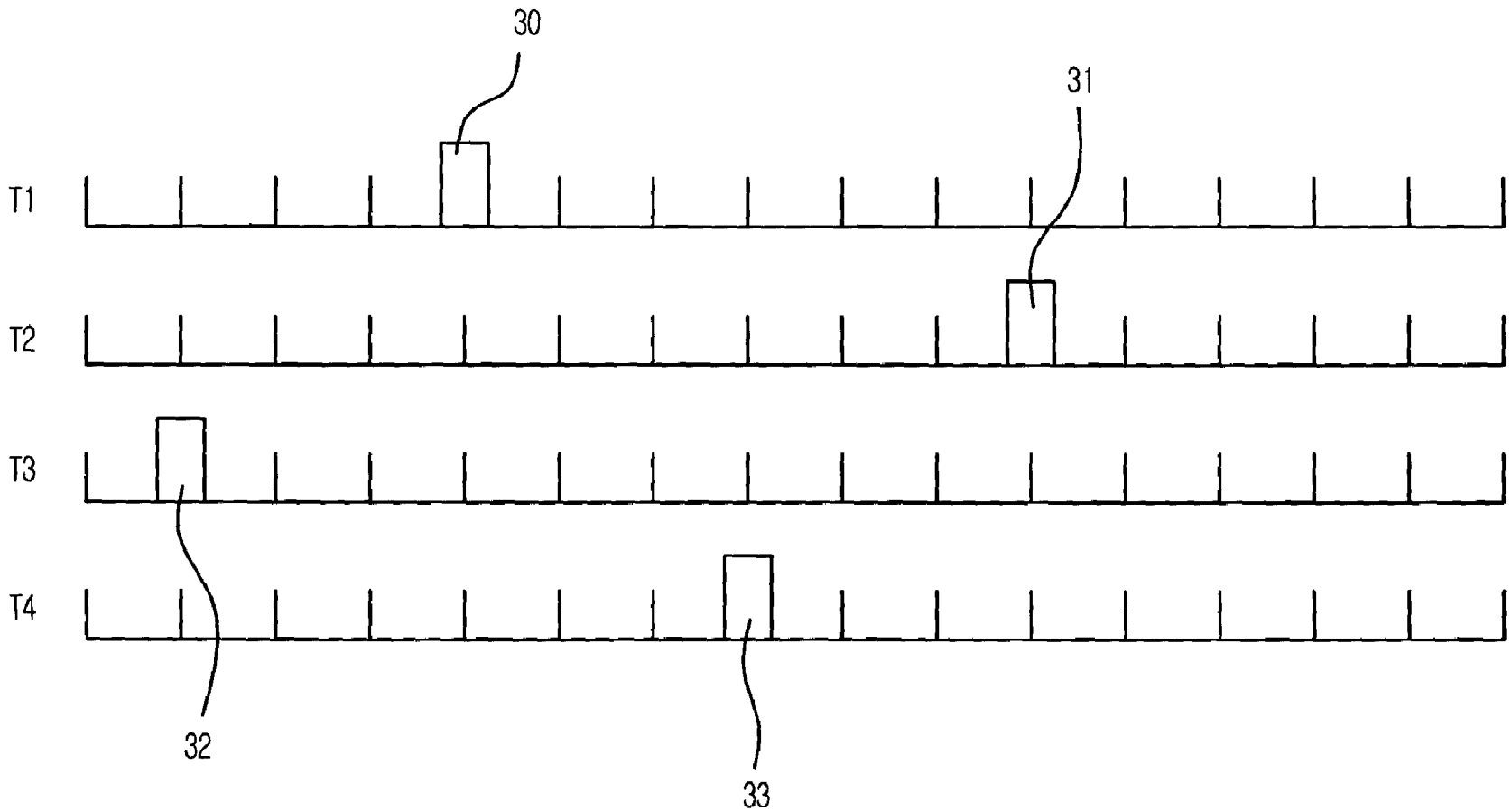
FIG. 3 provides a diagram representing a pulse position with a maximum value in each track for the flexible bit rate code vector generation in accordance with one embodiment of the present invention.
Figure 4A:
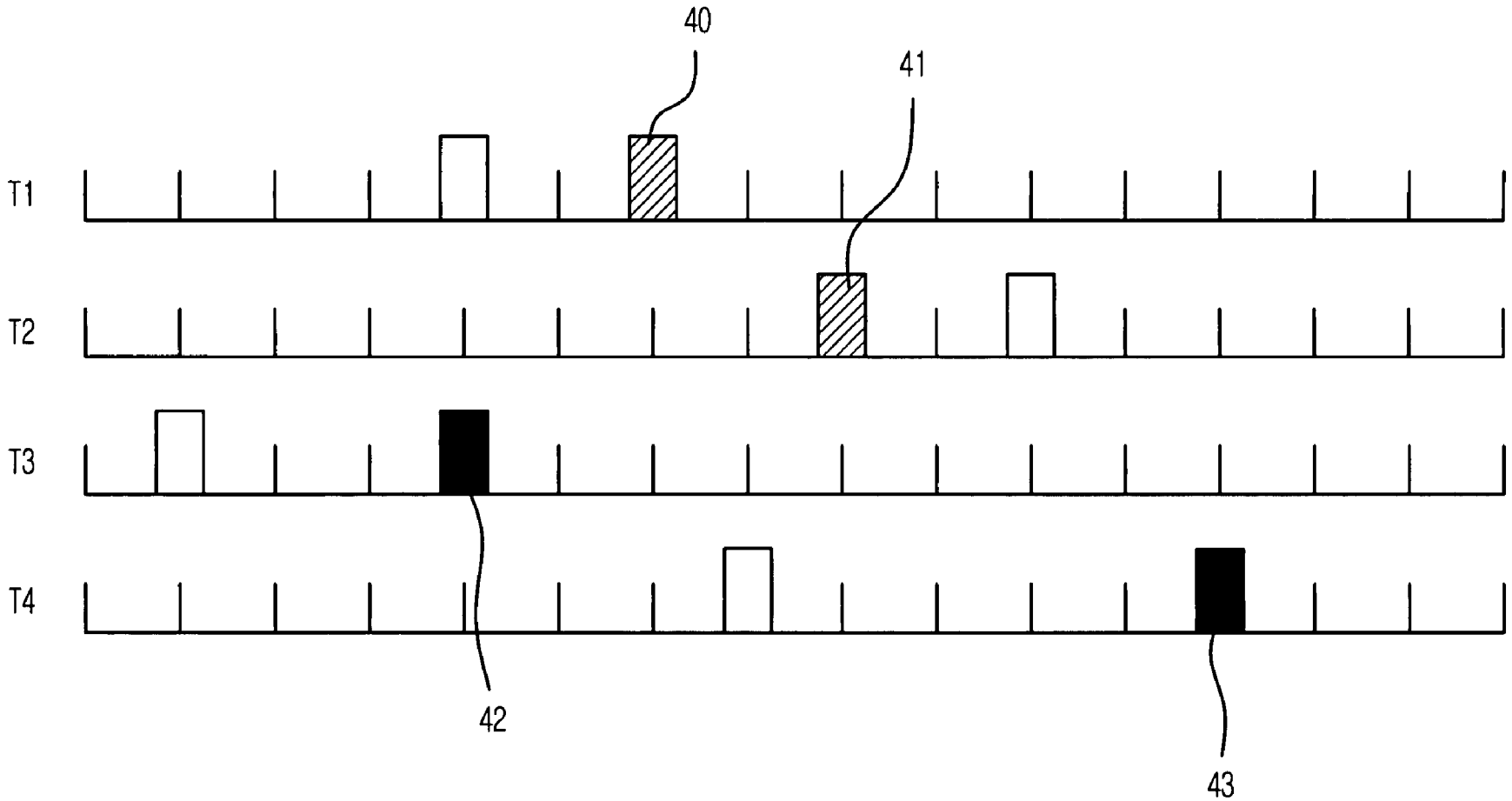
FIGS. 4A and 4B provide diagrams showing a process of combining and searching two pulses in consecutive tracks for the flexible bit rate code vector generation in accordance with one embodiment of the present invention.
Figure 4B:
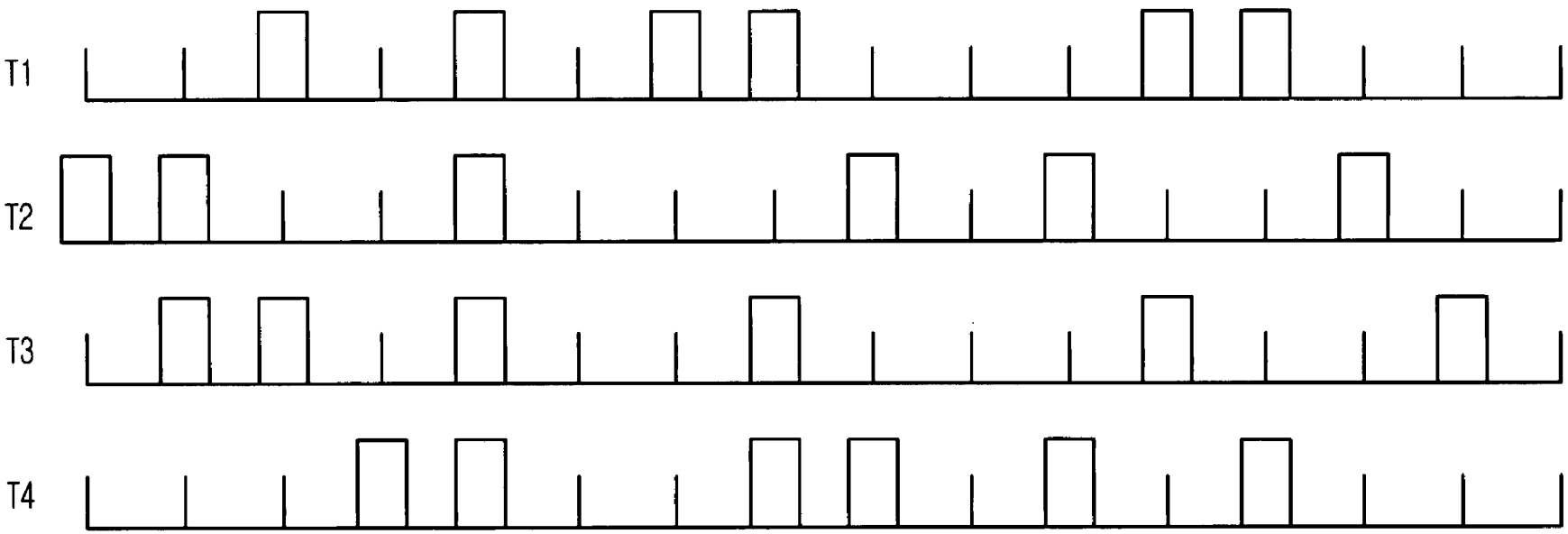

That is, at step S202, the pulses i(0) and i(1) in the first level are fixed to the positions, which are the numerals 30 and 31 in FIG. 3, with maximum values of the tracks T1 and T2. To be more specific, since the inventive process searches the total 24 pulses with pairs of 2 pulses, there exist the total 12 number of search levels and, among them, the pulses i(0) and i(1) in the first level are fixed to the positions with maximum values of tracks T1 and T2. And, the pulses i(2) and i(3) in the second level are fixed to the positions, which are the numerals 32 and 33 in FIG. 3, with maximum values of the tracks T3 and T4.

Next, in step S203, positions of two optimal pulses i(x) and i(y) in two consecutive tracks are searched. That is, at step S203, to decide the positions by means of a combination of the two pulses i(4) and i(5) in the third level, the optimal positions, which are the numerals 40 and 41 in FIGS. 4A and 4B, minimizing an error with the target signal in the following two consecutive tracks T1 and T2 are searched.

To determine the optimal positions of the pulses i(4) and i(5), in step S204, the value Qk, which is computed by Eq. (3), computed upon the search is stored for each pulse separately, to use in a pulse removal process later.

Thereafter, at step S205, after determining the positions of the pulses i(4) and i(5), it is checked whether or not the positions of the 24 pulses are all determined.

Until the positions of the 24 pulses are all determined, said steps S203 to S205 are repeatedly performed. That is, at step S203, to decide the positions by means of a combination of two pulses i(6) and i(7) in the fourth level, the optimal positions, which are the numerals 42 and 43 in FIGS. 4A and 4B, minimizing an error with the target signal in the following two consecutive tracks T3 and T4 are searched. By performing this process up to the $12^{th}$ level repeatedly, the process of the invention searches the optimal positions minimizing an error with the target signal in the subject tracks by combining the two pulses i(x) and i(y) in the $12^{th}$ level.

If the positions of the 24 pulses are determined all, at step S206, it may be seen that the search of the code vector (see FIG. 4B) with the highest bit rate composed of the 24 pulses has been also completed.

Figure 5A:
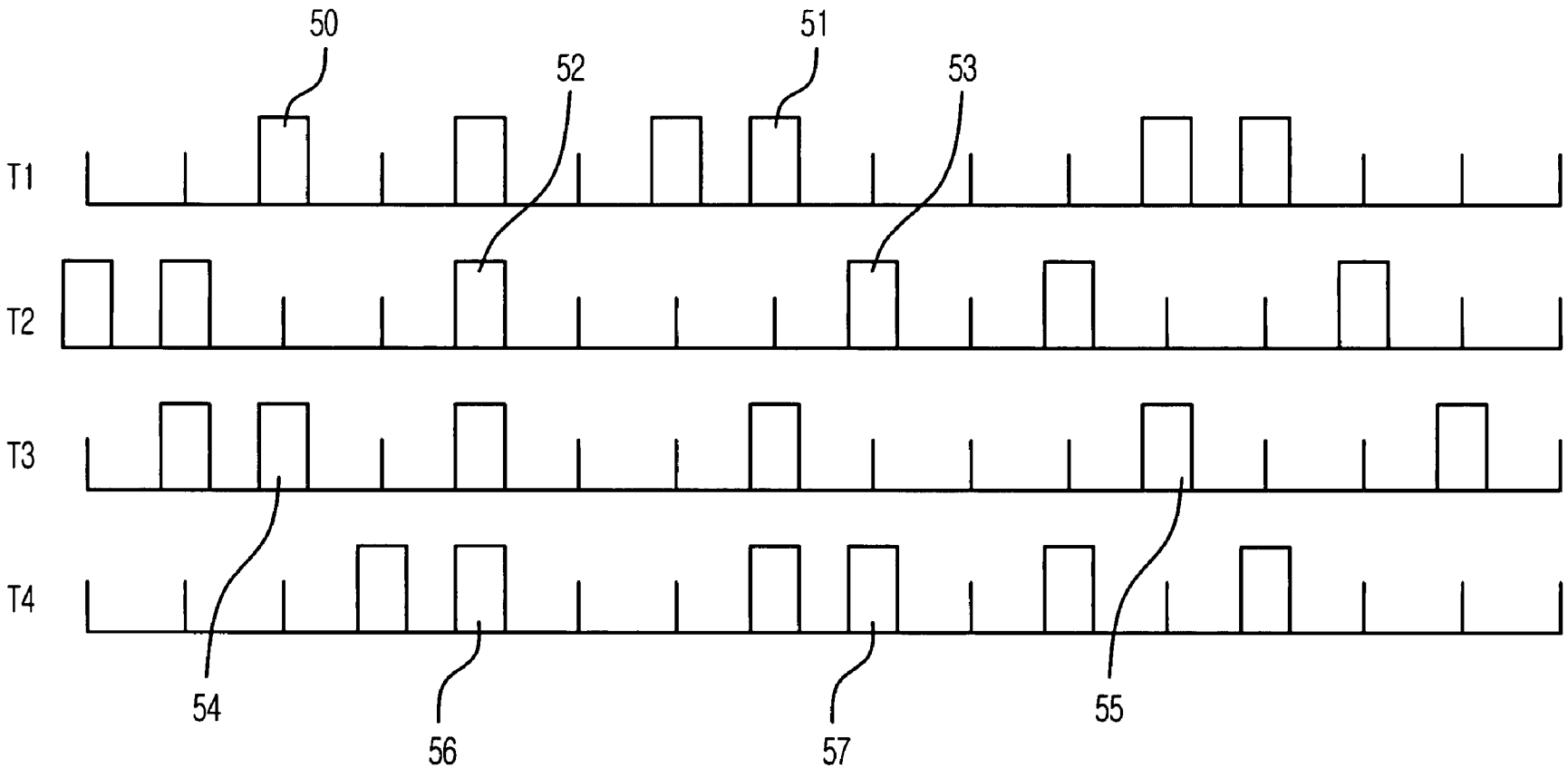
FIGS. 5A and 5B are diagrams showing a process of creating a code vector with four pulses per each track by removing two pulses with the low degree of contribution in each track for the flexible bit rate code vector generation in accordance with one embodiment of the present invention.
Figure 5B:
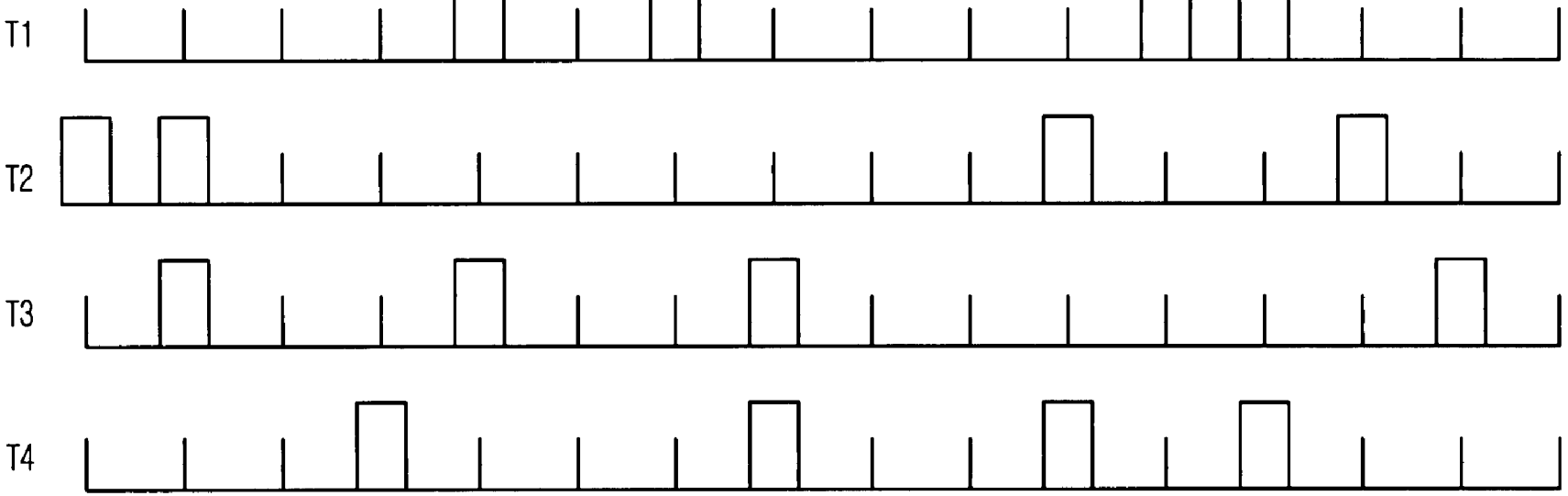

After that, in step S207, the 2 pulses, which are the numerals 50 to 57 in FIGS. 5A and 5B with the smallest degree of contribution in each track are decided by comparing the degree of contribution of each pulse stored in the step S204.

Next, in step S208, the 4 pulses for each track remain by removing the two pulses having the smallest degree of contribution in each track.

Thus, in step S209, if the 4 pulses for each track remain, the code vector composed of total 16 pulses is constructed (see FIG. 5B).

Figure 6A:
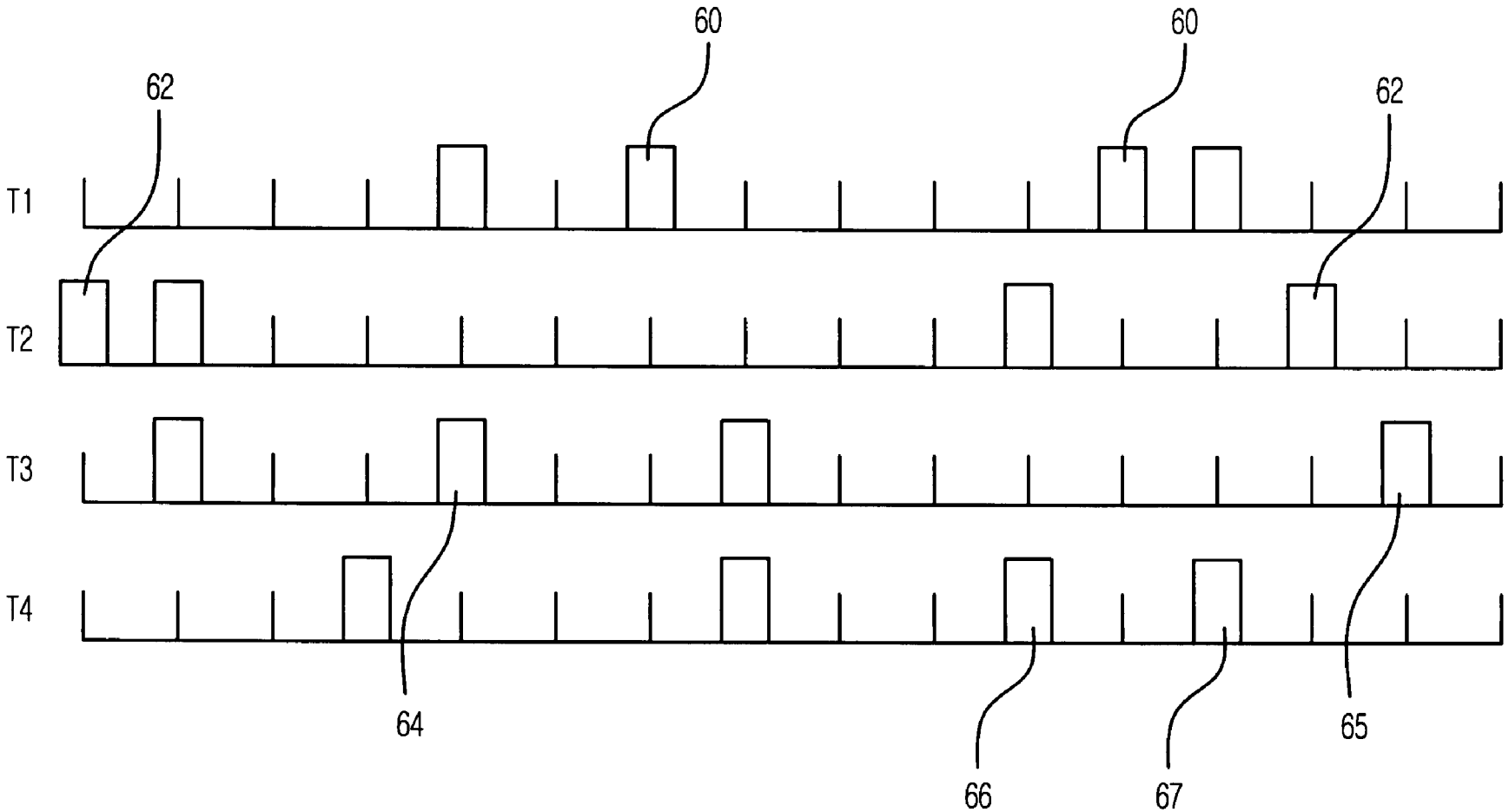
FIGS. 6A and 6B present diagrams depicting a process of creating a code vector with two pulses per each track by removing two pulses with the low degree of contribution in each track for the flexible bit rate code vector generation in accordance with one embodiment of the present invention.
Figure 6B:
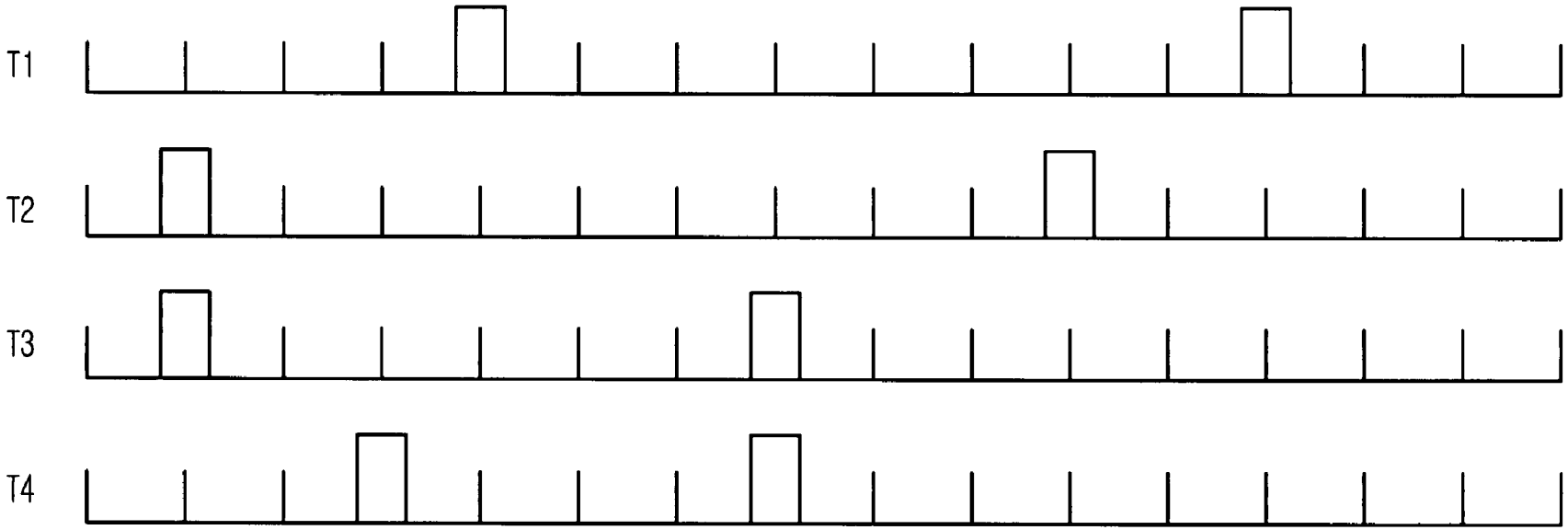

Further, in step S209, if said steps S207 and S208 are repeated once more, two pulses remain for each track, thus creating the code vector composed of total 8 pulses, with the lowest bit rate (see FIG. 6B).

As a result, through the algebraic codebook search, the 3 code vectors, which are composed of 24 pulses, 16 pulses, and 8 pulses, can be obtained at a time.

Although the flexible bit rate vocoder proposed in the invention provides the 3 types of code vectors at a time in the algebraic codebook search process, the number of bits necessary for encoding the pulses constituting those code vectors increases a bit, compared to the number of bits used in the AMR-WB vocoder. Table 3 below represents the number of bits necessary for encoding the pulses.

TABLE 3

| Number of pulses | Number of pulses per track | Number of bits necessary | Rate of total bits |
|---|---|---|---|
| 8 | 2 | 9 × 4 = 36 bits | 12.65 kbps |
| 16 | 4 | (9 + 9) × 4 = 72 bits | 19.85 kbps |
| 24 | 6 | (9 + 9 + 9) × 4 = 108 bits | 27.85 kbps |

As a result, in the number of bits necessary in encoding the algebraic codebook, the flexible bit rate vocoder provided in the present invention has a same performance for the lowest bit rate but lowers the encoding efficiency a bit for the two high bit rates, compared to the AMR-WB vocoder. However, it should be noted that this disadvantage is inevitable to provide the scalable bit rate. Further, if a portion of packets is corrupted by the fixed bit rate during the transfer as in the AMR-WB, such packets can not be used any more. Contrary to this, the flexible bit rate vocoder of the invention has a merit that, although a portion of packets is lost, the original voice can be reconstructed by using a packet of the lowest bit rate; and thus, it can allow a bit increase of the bit rate.

The following Table 4 shows a comparison of SNR performance for each bit rate between the flexible bit rate vocoder of the invention and the AMR-WB. To experiment the performance of the vocoder with the scalable bit rate, the encoding and decoding are performed for the three different it rates to obtain SNR. In Table 4 below, the results are compared with those measured in a similar manner for the AMR-WB.

TABLE 4

| Number of pulses | Flexible bit rate vocoder | AMR-WB |
|---|---|---|
| 8 | 14.15 (dB) | 14.96 (dB) |
| 16 | 16.91 (dB) | 17.19 (dB) |
| 24 | 18.56 (dB) | 18.56 (dB) |

As can be seen from Table 4, the flexible bit rate vocoder has a same SNR as the AMR-WB for the highest bit rate, but has a bit lower SNR than the AMR-WB for the remaining two low bit rates. However, since such performance reduction less than 1 dB is the reduction of voice quality that the ordinary person can not recognize, there would be no degradation of the actual voice quality. Rather, under the circumstance that many transfer errors are issued in the network, the optimal performance can be maintained by providing the flexible bit rate in accordance with the circumstance of the network, thus offering a superior voice quality.

As mentioned above, the method of the present invention may be implemented by a software program and may be stored in storage medium such as CD-ROM, RAM, ROM, floppy disk, hard disk, optical magnetic disk, etc., which are readable by a computer. Since this process can be readily conceived by those skilled in the art, a further description will be omitted for simplicity sake.

As a result, the present invention has an advantage that it can provide the flexible bit rate vocoder by improving the algebraic codebook search process of the AMR-WB vocoder.

Furthermore, the flexible bit rate wideband vocoder proposed in the invention has the three different bit rates, wherein the bit stream of 27.85 Kbps mode that is the bit rate providing the best voice quality contains the bit streams of the remaining two low bit rates. Therefore, although a portion of packets is lost in the network upon the transfer using the highest bit rate, the voice signal with basic quality can be restored by the bit stream of low bit rate included in the bit stream providing the best voice quality. And, if there is no packet loss, a voice of better quality can be reconstructed. Hence, the present invention can provide a highly useful method for the voice communication, in the network doing the packet communications such as the Internet, and so on.

Moreover, the present invention has a merit that it needs no additional resource for the flexible bit rate, by implementing such flexible bit rate without using the enhancement block as involved in the prior art.

The present application contains subject matter related to Korean patent application No. 2004-0098189, filed with the Korean Intellectual Property Office on Nov. 26, 2004, the entire contents of which is incorporated herein by reference.

While the present invention has been described with respect to the particular embodiments, it will be apparent to those skilled in the art that various changes and modifications may be made without departing from the spirit and scope of the invention as defined in the following claims.

What is claimed is:

1. A method of generating a flexible bit rate code vector in an encoder of a vocoder, comprising the steps of:

a) performing a preprocess, wherein the preprocess divides a sub-frame of a digitized speech signal by tracks and determines a pulse position having a maximum value in each track;

b) among a plurality of pulses to be searched, fixing a same number of pulses as the tracks to the position with the maximum value of each track sequentially, and searching optimal positions having a minimum error with a target signal by combining two pulses in two consecutive tracks for the remaining pulses;

c) creating a code vector with flexible bit rate by adjusting the number of pulses per each track by removing two pulses with a low degree of contribution in each track; and d) encoding the digitized speech signal using the code vector for the encoder.

2. The method as recited in claim 1, wherein said b) creates a code vector composed of 24 pulses, and said c) generates a code vector with 16 pulses.

3. The method as recited in claim 1, wherein said step b) creates a code vector having of 24 pulses, and said step c) produces code vectors composed of 16 and 8 pulses.

4. The method as recited in claim 1, wherein said step a) searches a maximum value in each track and appoints the maximum value as a local maximum value before an algebraic codebook search process, said step a) being performed by dividing a sub-frame with 64 samples by four tracks with 16 samples using a target signal that is derived by removing a linear prediction component and a pitch component, and searching a maximum value in each track to appoint a track with the maximum value as a local maximum value of said each track.

5. The method as recited in claim 4, wherein said step b) creates a code vector of the highest bit rate composed of 24 pulses, and said step b) includes the steps of:

b1) determining positions of first four pulses as positions with a local maximum value in each of the first to fourth tracks, wherein the first and the second pulses in a first level are fixed to positions with the maximum values in the first and the second tracks, and the third and the fourth pulses in a second level are fixed to positions with the maximum values in the third and the fourth tracks; and b2) searching positions of two optimal pulses having minimum error with a target signal in two consecutive tracks, among the remaining 20 pulses.

6. The method as recited in claim 5, wherein said step c) includes of the steps of:

c1) comparing the degree of contribution of each pulse in each track to determine two pulses with the lowest degree of contribution in said each track; and c2) creating the code vector composed of the total 16 pulses, wherein the 16 pulses are obtained by combining four pulses for said each track that remain after removing the two pulses with the lowest degree of contribution in said each track.

7. The method as recited in claim 6, wherein said step c) further includes the steps of:

c3) among the remaining four pulses for said each track, comparing the degree of contribution of each pulse in said each track to determine two pulses with the lowest degree of contribution in said each track; and c4) creating the code vector composed of total 8 pulses that are obtained by combining two pulses for said each track that remain after removing the two pulses with the lowest degree of contribution.

8. A wideband vocoder for encoding and transmitting a code vector created by a code vector generation method, wherein the vocoder derives at least two types of excitation code vectors at a time in an algebraic codebook search process, by adjusting the number of pulses for each track by removing pulses with a low degree of contribution in each track.

9. The wideband vocoder as recited in claim 8, wherein said at least two types of excitation code vectors are code vectors composed of 24 and 16 pulses, or code vectors with 24, 16, and 8 pulses.

* * * * *